US006305952B1

(12) United States Patent
Yu

(10) Patent No.: US 6,305,952 B1
(45) Date of Patent: Oct. 23, 2001

(54) ELECTRICAL CARD CONNECTOR

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,205

(22) Filed: Dec. 29, 2000

(30) Foreign Application Priority Data

Nov. 28, 2000 (TW) ..... 89220646 U

(51) Int. Cl.[7] ..... H01R 12/00

(52) U.S. Cl. ..... 439/83; 439/79; 439/733.1; 439/636

(58) Field of Search ..... 439/83, 64, 79, 439/733.1, 636, 326

(56) References Cited

U.S. PATENT DOCUMENTS 5,037,316 * 8/1991 Fukushima et al. ..... 439/83
5,836,780 * 11/1998 Mizumura et al. ..... 439/326
5,839,913 * 11/1998 Fumikura ..... 439/326
5,894,708 * 11/1999 Yu ..... 438/326

* cited by examiner

*Primary Examiner*—Tho D. Ta
(74) *Attorney, Agent, or Firm*—Wei Te Chung

(57) ABSTRACT

A PCMCIA card connector (1) includes a dielectric housing (20) and a plurality of first and second terminals (31, 32) received in the dielectric housing. The dielectric housing defines a front mating face (25) for engaging with an electronic card (not shown) and a rear face 23 opposite the mating face. The first and second terminals have solder tails (31*c*, 32*c*) for soldering to a printed circuit board (4). The solder tails of the first terminals extend forwardly beyond the mating face. The solder tails of the second terminals extend rearwards beyond the rear face.

5 Claims, 4 Drawing Sheets

ELECTRICAL CARD CONNECTOR

BACKGROUND OF THE INVENTION

1. Field of the Invention

The present invention relates to an electrical card connector, and particularly to an electrical card connector which has a reduced length thereby reducing occupying area on a printed circuit board.

2. Description of Prior Art

As the popularity of notebook computers increases, integrated circuit (IC) cards are becoming more common for increasing storage capacity or for interfacing the notebook computers with other devices. Card connectors are commonly used to connect mother boards of the computers with the cards. Most current IC cards and card connectors conform to the standard of Personal Computer Memory Card International Association (PCMCIA).

Conventional PCMCIA card connectors are disclosed in U.S. Pat. No. 5,601,438 and Taiwan Patent Application Nos. 84206174 and 84206175. Referring to FIG. 4, a conventional PCMCIA card connector 7 comprises a dielectric housing 71 and a plurality of terminals 72, 73 arranged in upper and lower rows. The dielectric housing 71 defines a plurality of receiving passageways 711, 712 in upper and lower rows for receiving corresponding terminals 72, 73. The terminals 72, 73 define mounting portions 72*a*, 73*a* received in the receiving passageways 711, 712. Contact potions 72*b*, 73*b* extend forwardly from the mounting portions 72*a*, 73*a* beyond the dielectric housing 71 to mate with an electronic card (not shown) inserted into the connector 7. Solder tails 72*c*, 73*c* extend rearwardly and downwardly from the mounting portions 72*a*, 73*a* and are soldered to a printed circuit board 8.

The terminals 72, 73 are mounted to the housing 71 by inserting the terminals 72, 73 into the housing 71 from a rear side of the housing 71. In order to have the solder tails 72*c*, 73*c* suitably spaced so that a short circuit between the tails 72*c*, 73*c* will not happen, the solder tails 72*c*, 73*c* are arranged in front and rear rows behind the housing 71. Such an arrangement causes the card connector 7 to have a large length, which in turn causes the card connector 7 to occupy a relative large area of the printed circuit board 8 of the notebook computer. The real estate of the printed circuit board is more and more precious due to the minimization of the notebook computer.

Hence, an improved electrical card connector is required to overcome the disadvantages of the conventional electrical card connector.

SUMMARY OF THE INVENTION

Accordingly, a main object of the present invention is to provide a PCMCIA card connector having a reduced length thereby reducing its occupying area on a printed circuit board.

In order to achieve the object set forth, a PCMCIA card connector in accordance with the present invention includes a dielectric housing and a plurality of first and second terminals received in the dielectric housing. The dielectric housing defines a mating face for engaging with an electronic card, a rear face opposite the mating face and a lower interface facing a printed circuit board. The dielectric housing further defines a plurality of mounting holes for receiving the first and second terminals. The first and second terminals are inserted into the dielectric housing from front and rear sides thereof, respectively. Each terminal defines a contact portion, a solder tail and a mounting portion. The contact portions extend out of the mating face for mating with the electronic card. The solder tails are soldered to the printed circuit board. The mounting portions are secured in receiving passageways defined by the dielectric housing thereby securing the terminals to the dielectric housing. The solder tails of the first terminals extend forwardly beyond the mating face. The solder tails of the second terminals extend rearwardly beyond the rear face of the housing.

Other objects, advantages and novel features of the invention will become more apparent from the following detailed description when taken in conjunction with the accompanying drawings.

DETAILED DESCRIPTION OF PREFERRED EMBODIMENTS

Figure 1:
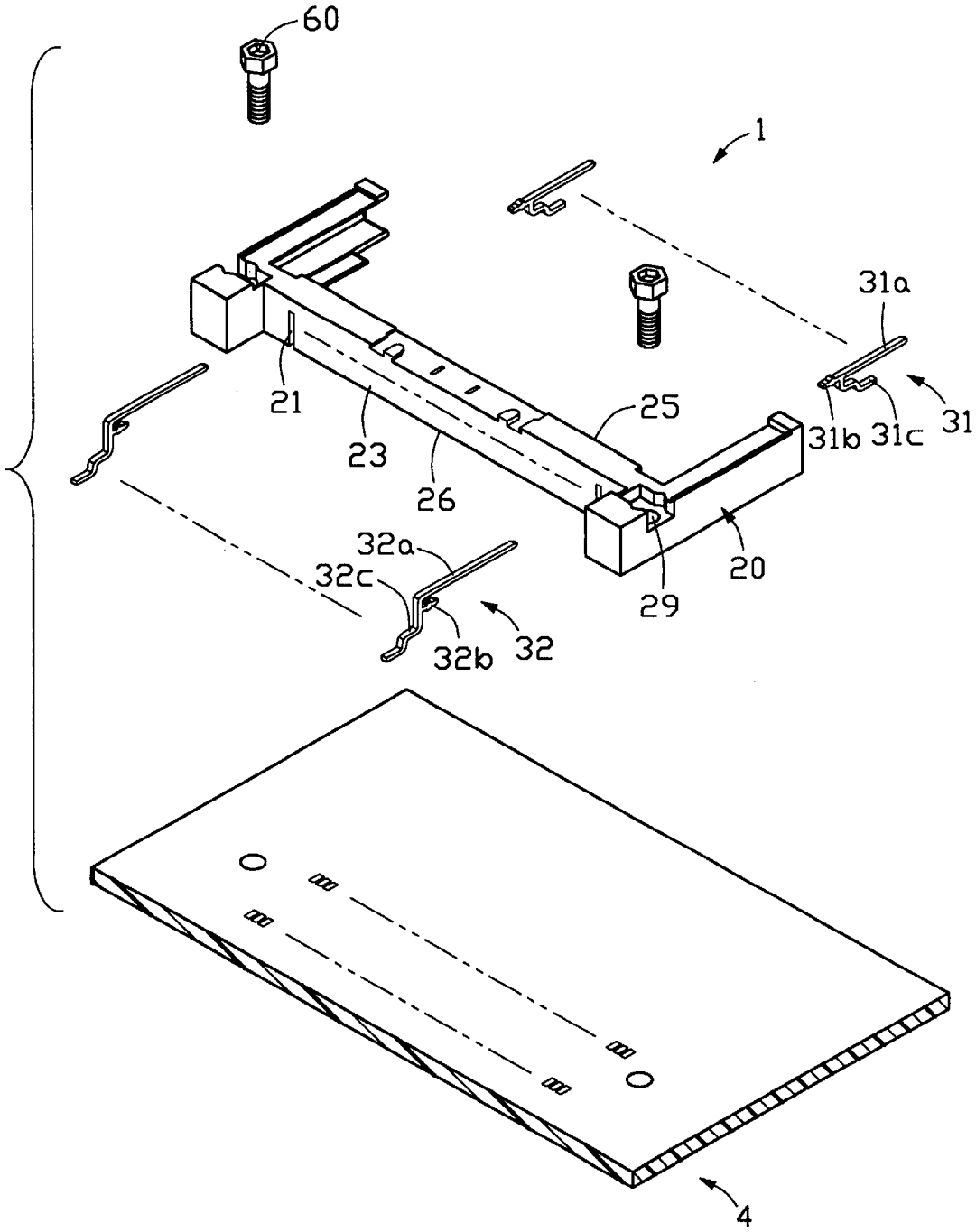
FIG. 1 is an exploded perspective view of a PCMCIA card connector in accordance with a first embodiment of the present invention and a printed circuit board.

Reference will now be made to the drawing figures to describe the present invention in detail.

Figure 2:
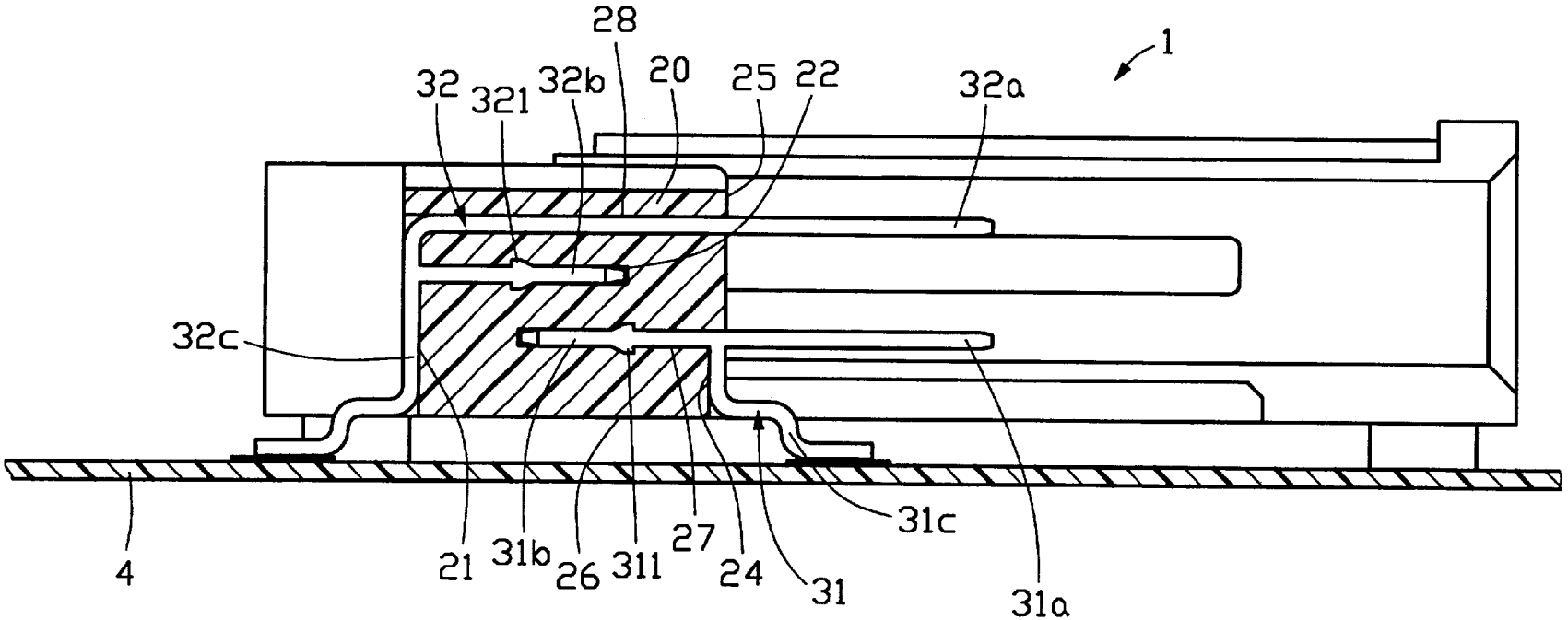
FIG. 2 is a cross-sectional view of the PCMCIA card connector of FIG. 1 assembled on the printed circuit board.

Referring to FIG. 1 and FIG. 2, a PCMCIA card connector 1 in accordance with a first embodiment of the present invention includes a dielectric housing 20, a plurality of first terminals 31 and second terminals 32 respectively arranged in lower and upper rows, and a pair of bolts 60.

The dielectric housing 20 defines a mating face 25 for engaging with an electronic card (not shown) inserted into the connector 1 and a lower face 26. The housing 20 defines a plurality of lower and upper receiving passageways 27, 28 in which each lower receiving passageway 27 is depressed rearwards from the mating face 25 of the housing 20 a distance, while each upper receiving passageway 28 extends through the mating face 25 and a rear face 23 opposite the mating face 25.

The first and second terminals 31, 32 respectively define contact portions 31*a*, 32*a* for mating with the inserted electronic card. Solder tails 31*c*, 32*c* extend downwardly from corresponding contact portions 31*a*, 32*a*. Each first terminal 31 comprises a mounting portion 31*b* extending directly rearwardly from a rear end of the contact portion 3l*a* in which the tail 31*c* is directly projected downwardly from a junction between the contact portion 31*a* and the mounting portion 31*b*. Each second terminal 32 includes a mounting potion 32*b* extending forwardly from an upper portion of the solder tail 32*c* in a direction parallel with the contact portion 32*a*. The mounting portions 31*b*, 32*b* form protrusions 311, 321 biting the housing 20 thereby securing the terminals 31, 32 to the dielectric housing 20. The solder tails 31*c*, 32*c* extend below the lower face 26 from the receiving passageways 27, 28 and are soldered to a printed circuit board 4 thereby establishing an electrical connection between the connector 1 and the printed circuit board 4.

In addition, the dielectric housing 20 further defines a plurality of long vertical recesses 21 in the rear face 23 of the housing 20 opposite the mating face 25 wherein each long recess 21 has a top end in communication with a corresponding horizontal upper passageway 28, and a plurality of short vertical recesses 24 in the mating face 25 wherein each short recess 24 has a top end in communication with a corresponding horizontal lower passageway 27. The housing 20 further defines a plurality of horizontally extending mounting passageways 22 recessed forwardly from the rear face 23 of the housing 20 opposite the mating face 25, wherein each mounting passageway 22 communicates with a corresponding long recess 21 at a position below the top end of the long recess 21. The dielectric housing 20 further defines retention holes 29 for extension of the bolts 60 to fix the connector 1 to the printed circuit board 4.

In assembly, the second terminals 32 are inserted into the dielectric housing 20 from a rear side thereof to a position wherein the contact portions 32*a* are received in the receiving passageways 28 with a mating section thereof protruding forwardly beyond the mating face 25 of the housing 20, and the mounting portions 32*b* are received in the mounting passageways 32 in which the protrusions 321 bite into the housing 20 to secure the second terminals 32 to the housing 20. The vertical portion of each solder tail 32*c* is fitted in a corresponding long recess 21 while a horizontal portion of the solder tail 32*c* is horizontally rearwards extended from a lower end of the vertical portion of the solder tail 32*c*. The first terminals 31 are inserted into the dielectric housing 20 from a front side thereof to a position wherein the mounting portions 31*b* of the first terminals 31 are fitted in the lower receiving passageways 27 with the protrusions 311 biting into the housing 20 thereby securing the first terminals 31 to the housing 20. A vertical portion of each solder tail 31*c* is fitted in a corresponding short recess 24 while a horizontal portion of the solder tail 31*c* horizontally and forwardly extends from a lower end of the vertical portion. The contact portions 31*a* protrude forwardly beyond the mating face 25 of the housing 20. The bolts 60 are assembled to the printed circuit board 4 through the dielectric housing 20 to mount the dielectric housing 20 on the printed circuit board 4. Finally, the horizontal portions of the solder tails 31*c*, 32*c* are soldered to the printed circuit board 4.

The terminals 31, 32 are inserted into the dielectric housing 20 from two opposite sides thereof and the solder tails 31*c*, 32*c* are located at different sides of the dielectric housing 20. Therefore, the length of the PCMCIA card connector 1 can be reduced thereby decreasing the occupying area of the connector 1 on the printed circuit board 4.

Figure 3:
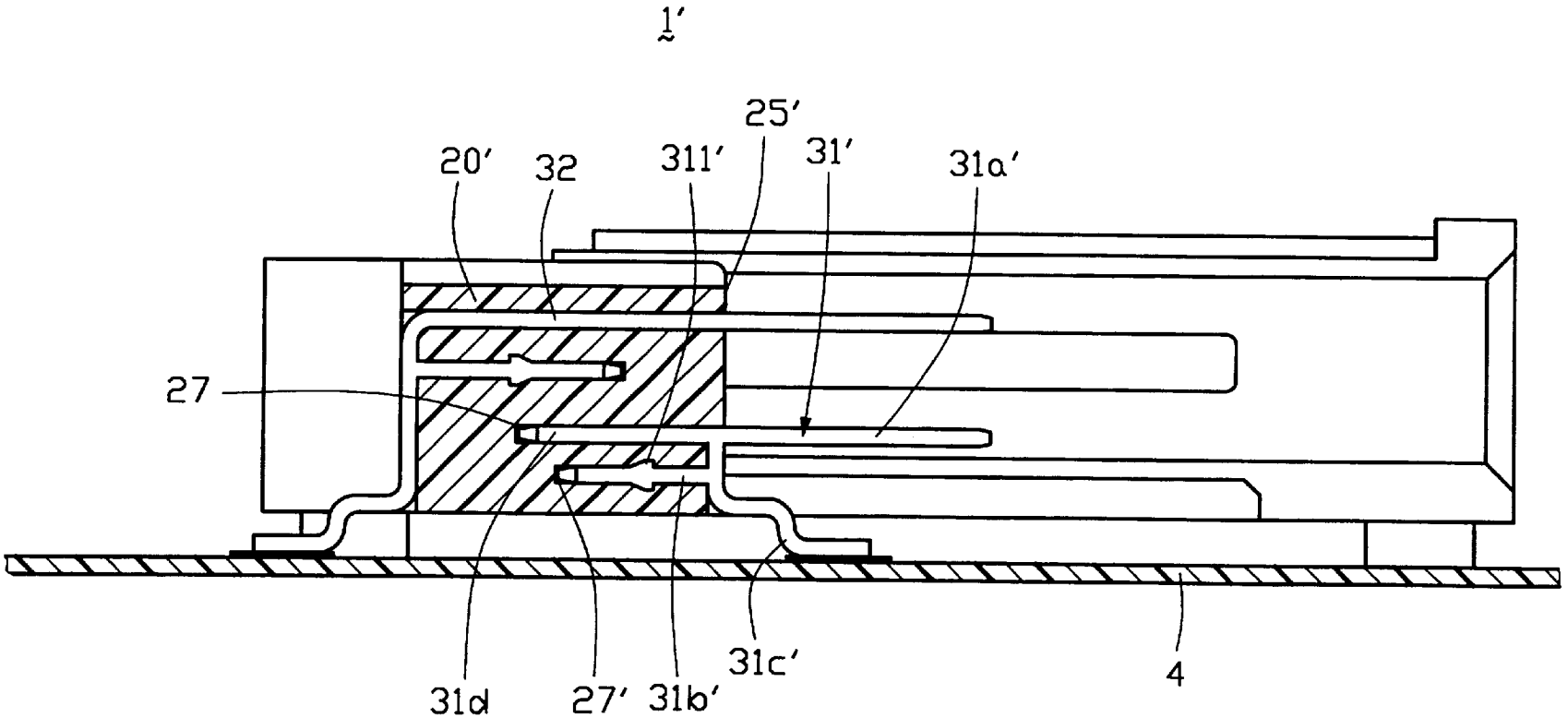
FIG. 3 is a cross-sectional view of a PCMCIA card connector in accordance with an alternative embodiment of the present invention in which the card connector is assembled on a printed circuit board.
Figure 4:
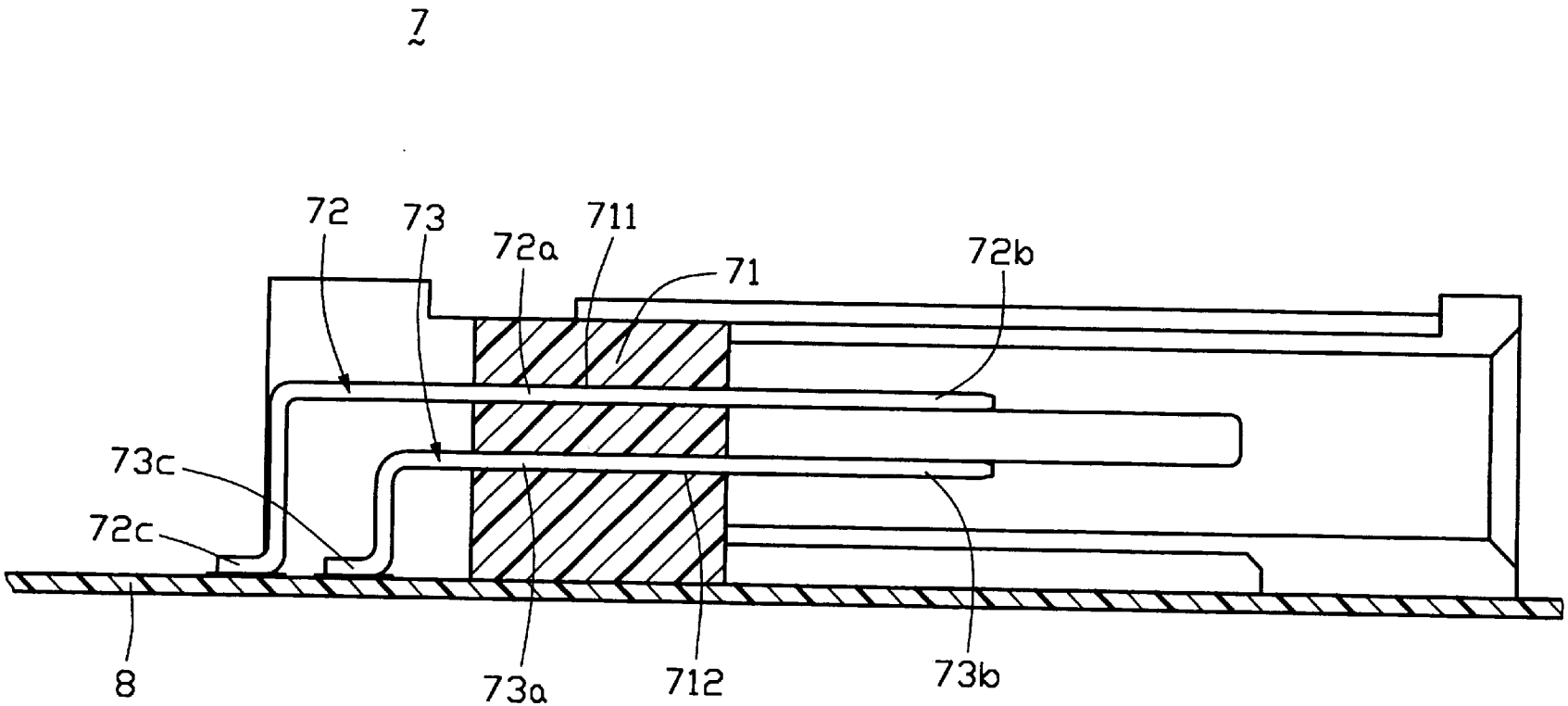
FIG. 4 (PRIOR ART)
FIG. 4 is a cross-sectional view of a conventional PCMCIA card connector which is mounted on a printed circuit board.

Referring to FIG. 3, a PCMCIA card connector 1' in accordance with an alternative embodiment is shown. In the alternative embodiment, the connector 1' has second terminals 32 each having a structure and being mounted into a housing 20' of the connector 1' in a manner similar to the first embodiment. The housing 20' further defines a plurality of receiving holes 27' below the lower receiving passageways 27. A plurality of first terminals 31' each have a contact portion having front and rear halves 31*a*', 31*d* in which the front half 31*a*' is protruded forwardly from a mating face 25' of the housing 20' while the rear half 31*d* is received in a corresponding receiving passageways 27. A solder tail 31*c*' is extended downwardly from a junction between the front and rear halves 31*a*', 31*d*. A mounting portion 31*b*' extends rearwards from a vertical portion of the solder tail 31*c* into the receiving hole 27'. The mounting portion 31*b*' forms protrusions 311' biting into the housing 20' thereby securing the lower terminals 31'to the housing 20'. The solder tail 31*c*' has a horizontal portion extending forwardly from a lower end of the vertical portion and surface mounted to the printed circuit board 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector for interconnecting an electronic card with a printed circuit board on which the electrical card connector is mounted, comprising:

a dielectric housing defining a front mating face for mating with the electronic card and a rear face opposite to the mating face; and a plurality of first and second terminals received in the dielectric housing, each terminal defining a contact portion, a mounting portion and a solder tail, the contact portion of the first terminal having front and rear halves, the front half extending forwardly beyond the mating face for mating with the electronic card while the rear half being received in the housing, the contact portion of the second terminal extending forwardly beyond the mating face for mating with the electronic card, the mounting portion extending into the housing from an upper vertical portion of the solder tail and forming protrusions biting into the housing for securing to the housing, the solder tails of the first terminals extending forwardly beyond the mating face for soldering to the printed circuit board and the solder tails of the second terminals extending rearwards beyond the rear face for soldering to the printed circuit board.

2. The electrical card connector in accordance with claim 1, wherein the vertical portion of the solder tail of each of the first terminal extends downwards from a junction between the front and rear halves of the first terminal.

3. The electrical card connector in accordance with claim 1, wherein the dielectric housing defines recesses in the mating and rear faces of the housing, the vertical portion of the solder tail fitted in a corresponding recess.

4. The electrical card connector in accordance with claim 3, wherein each solder tail has a horizontal portion extending from a bottom of a corresponding vertical portion for soldering to the printed circuit board.

5. An electrical card connector comprising:

a dielectric housing having a front face and rear face opposite to said front face;

upper and lower rows of terminals disposed in the housing;

each of the terminals in the upper row including a first contact portion extending from the rear face toward and beyond the front face, a first solder tail downwardly from a rear end of the first contact portion along a rear face, and a first mounting portion extending from the first solder tail forwardly into the housing for retaining the corresponding terminals in the housing; and each of the terminals in the lower row including a second contact portion extending from the front face forwardly away from the rear face and exposed outside said front face, a second solder tail downwardly extending from a rear end of the second contact portion along the front face, and a second mounting portion rearwardly extending from the second solder tail into the housing for retaining the corresponding terminal in the housing.

* * * * *